US007597767B1

(12) United States Patent
Fathbruckner

(10) Patent No.: US 7,597,767 B1
(45) Date of Patent: Oct. 6, 2009

(54) PAINT GUN CLEANING APPARATUS

(75) Inventor: Bryan Fathbruckner, Delaware, OH (US)

(73) Assignee: Honda Motor Co., Ltd., Tokyo (JP)

( * ) Notice: Subject to any disclaimer, the term of this patent is extended or adjusted under 35 U.S.C. 154(b) by 587 days.

(21) Appl. No.: 11/095,627

(22) Filed: Mar. 31, 2005

(51) Int. Cl.
*B08B 5/04* (2006.01)

(52) U.S. Cl. ..... 134/21; 134/22.1; 134/38; 15/300.1; 15/301; 15/310; 15/422.2; 118/302

(58) Field of Classification Search ..... 15/301, 15/306.1, 304, 353, 300.1, 302, 303, 310, 15/422.2; 118/302; 134/21, 22.1, 38, 22.11, 134/22.12, 18, 42, 166 R, 169 R, 169 C, 134/170; 239/104, 223, 224
See application file for complete search history.

(56) References Cited

U.S. PATENT DOCUMENTS

| | | | | | |
|---|---|---|---|---|---|
| 1,637,067 | A * | 7/1927 | Wieckhorst | 15/310 |
| 2,159,176 | A * | 5/1939 | Nelson | 15/310 |
| 2,477,948 | A * | 8/1949 | Allen | 241/40 |
| 4,202,070 | A * | 5/1980 | Harfst | 15/422.2 |
| 4,350,720 | A | 9/1982 | Scharfenberger | |
| 4,403,736 | A | 9/1983 | Scharfenberger | |
| 4,771,579 | A * | 9/1988 | Giese | 451/88 |
| 4,813,603 | A | 3/1989 | Takeuchi et al. | |
| 4,823,820 | A * | 4/1989 | Larson et al. | 134/109 |
| 4,881,563 | A | 11/1989 | Christian | |
| 4,902,352 | A | 2/1990 | Christian | |
| 4,934,393 | A * | 6/1990 | Lighthall et al. | 118/302 |
| 5,072,881 | A | 12/1991 | Taube, III | |
| 5,402,938 | A | 4/1995 | Sweeney | |
| 5,693,150 | A * | 12/1997 | Powell | 134/38 |
| 6,533,834 | B2 * | 3/2003 | Conrad et al. | 15/353 |
| 6,569,258 | B2 | 5/2003 | Clifford et al. | |
| 6,810,557 | B2 * | 11/2004 | Hansen et al. | 15/353 |
| 7,014,671 | B2 * | 3/2006 | Oh | 55/DIG. 3 |
| 2003/0127046 | A1 * | 7/2003 | Zehner et al. | 118/302 |

FOREIGN PATENT DOCUMENTS

| | | |
|---|---|---|
| DE | 36 20 079 A1 | 12/1987 |
| EP | 0 202 692 A2 | 11/1986 |

* cited by examiner

*Primary Examiner*—Mark Spisich
(74) *Attorney, Agent, or Firm*—Rankin, Hill & Clark LLP; Vincent Ciamacco

(57) ABSTRACT

A paint gun cleaning apparatus is provided that prevents the collection of overspray on the discharge end of the paint gun. The cleaning apparatus includes a drum that defines an aperture for insertion of at least the discharge end of a paint gun. The apparatus also includes a fin assembly inside of the drum for directing paint and solvent discharged from the paint gun away from the paint gun. A splash cone also helps direct discharge away from the center of the drum, laterally toward the fin assembly. The apparatus also includes a source of suction for drawing material discharged from the paint gun away from the discharge end of the paint gun. By preventing the collection of overspray it is not necessary for an operator to wipe the gun clean.

16 Claims, 4 Drawing Sheets

PAINT GUN CLEANING APPARATUS

BACKGROUND OF THE INVENTION

1. Field of the Invention

The present invention relates to an apparatus used in conjunction with a paint gun having a bell atomizer, and specifically a cleaning apparatus used during paint color change operations.

2. Description of Related Art

Paint guns with bell atomizers are often a part of paint machines used extensively within industry for high volume painting operations such as the painting of motor vehicles. Often, the paint machine is robotically controlled. A paint and solvent mixture is forced through the paint machine until the mixture reaches the paint gun. A discharge end of the paint gun includes a rotating bell shaped member that aids in atomizing the paint and solvent mixture, thus, allowing superior application of the mixture.

Periodically the color of paint within the paint machine is changed. Prior to introducing a new color mixture into the machine, a strictly solvent blend is circulated through the machine to clean out traces of the previous color mixture. Then, the new color mixture is added to the machine and sprayed through the paint gun for a predetermined period of time before the mixture is applied to products. During changeover, collection of any overspray consisting of the solvent or new color mixture on the paint gun, including the bell, is to be avoided.

Current practice during changeover involves spraying the solvent into a funnel. This practice has inherent drawbacks. Although the funnel collects the overspray, it does not prevent overspray from accumulating on the discharge end of the paint gun (i.e. the nozzle and rotating bell). It is necessary for an operator to physically wipe the overspray off of the paint gun with a rag. This is a time consuming process and a safety hazard. The bell of the paint gun rotates at 35,000 rpm during operation and although the means of driving the bell is disconnected during changeover, the operator has to wait for the bell to stop rotating to wipe it or contact the moving bell with the rag.

What is desired is an improved method and/or apparatus that can reduce changeover time by preventing the collection of overspray on the paint gun and also increase operator safety.

BRIEF SUMMARY OF THE INVENTION

The present invention overcomes these and other disadvantages in the prior art. The paint gun cleaning apparatus prevents the collection of overspray on the discharge end of the paint gun. Thus, it is not necessary for an operator to wipe the gun clean.

In accordance with the present invention, the cleaning apparatus includes a drum that defines an aperture for insertion of at least the discharge end of a paint gun. The apparatus also includes a fin assembly inside of the drum for directing paint and solvent discharged from the paint gun away from the paint gun. A splash cone helps direct discharge away from the center of the drum, laterally toward the fin assembly. The apparatus also includes a source of suction for drawing material discharged from the paint gun away from the discharge end of the paint gun.

These and other aspects of the invention are herein described in particularized detail with reference to the accompanying figures.

DETAILED DESCRIPTION OF THE INVENTION

Figure 1:
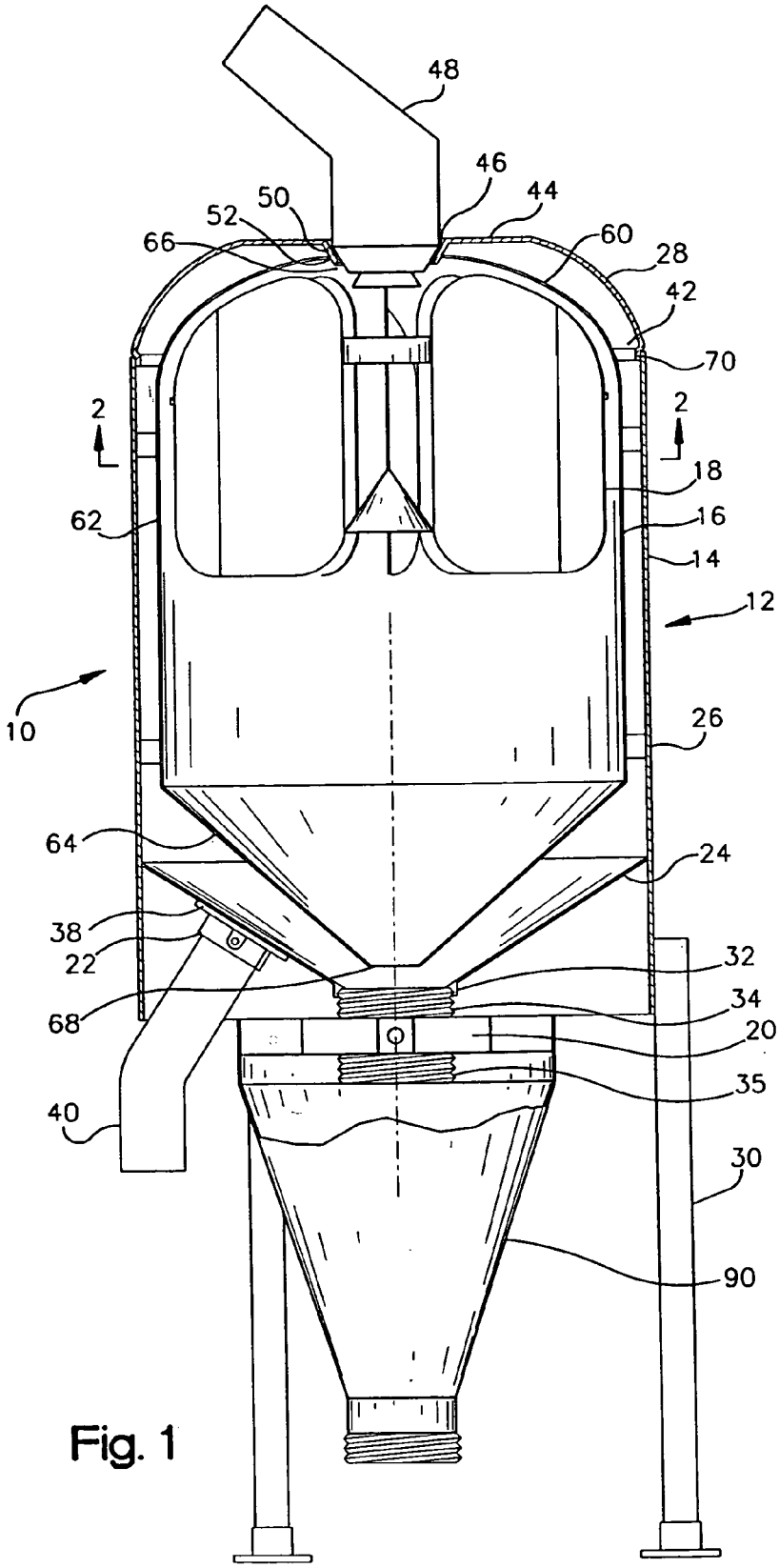
FIG. 1 is a vertical cross-sectional view of a paint gun cleaning apparatus of the present invention.
Figure 3:
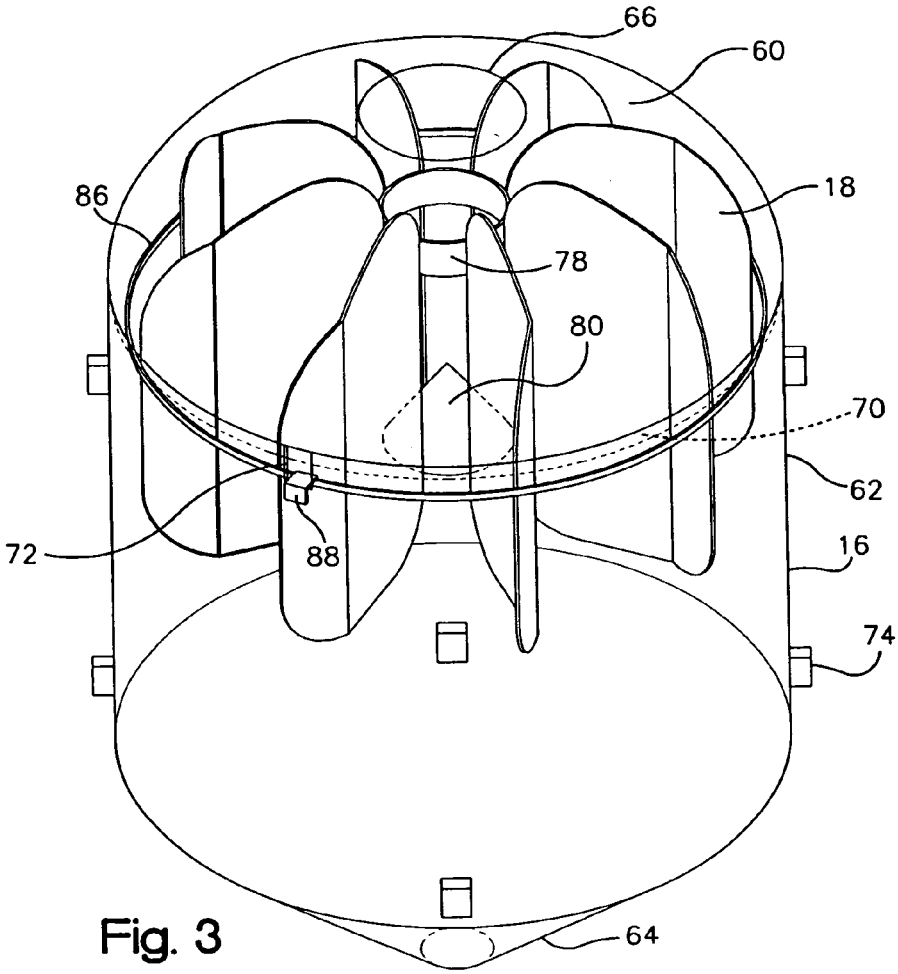
FIG. 3 is a perspective view of the inner structure of the paint gun cleaning apparatus.

Referring to the drawings, specifically FIGS. 1 and 3, a preferred paint gun cleaning apparatus 10 according to the present invention is illustrated. The gun cleaning apparatus 10 includes a drum 12 having an outer skin 14 and inner structure 16, a fin assembly 18 housed within the inner structure 16, and multiple sources of suction 20, 22.

Referring to FIG. 1, the drum outer skin 14 includes a base section 24, mid-section 26 and a lid section 28. The outer skin 14 is supported at a desirable height by four legs 30 (not all shown). The mid-section 26 has a generally circular cross section and extends between the base section 24 and the lid section 28, the mid section 26 overlapping some or all of the base section 24. The base section 24 has a generally conical shape that tapers downwardly from a junction with the mid-section 26 to a first circular flange 32. One end of a threaded nipple 34 is attached to the first flange 32 and a first source of suction 20 is attached to the opposite end of the threaded nipple 34. A second flange 38 is placed on a portion of the conical base section 24 around an aperture extending therethrough. A second source of suction 22 is attached to the second flange 38.

The lid section 28 is detachably fit over an open top end 42 of the mid-section 26. The lid section 28 has a dome shape that is truncated to provide a planer top center portion 44. An aperture 46 is defined in the center portion 44 through which a paint gun discharge end 48 (nozzle and bell) extends during changeover events. The aperture 46 is surrounded by a beveled flange 50 that extends inwardly. The shape of the beveled flange 50 matches the shape of an associated portion of the paint gun discharge end 48 and as a result a rough seal is formed when the paint gun 48 is inserted into the aperture 46 and against the beveled flange 50. Preferably a gap of 1.25 centimeters (0.5 inches) is maintained between the paint gun 48 and the beveled flange 50. A rubber seal 52 is attached to the beveled flange 50 to protect the paint gun discharge end 48 from rebounding paint and/or solvent.

Figure 5:
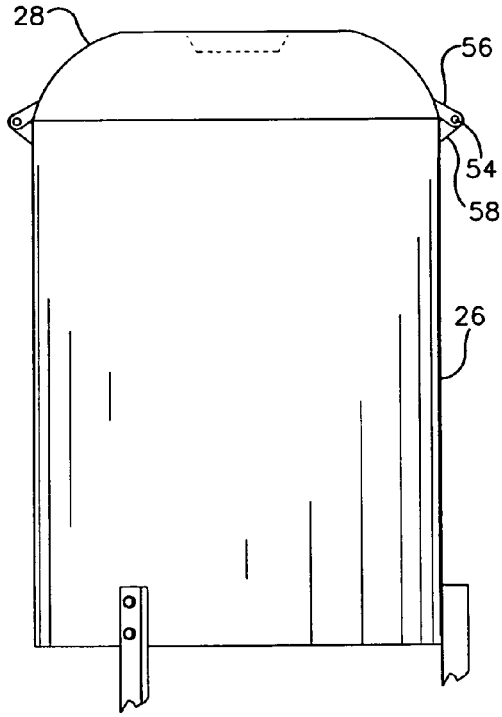
FIG. 5 is a front elevational view of the paint gun cleaning apparatus.

Referring to FIG. 5, the lid section 28 is removable, and can be locked in place, preferably using pins 54. Two or more ears 56 are attached to the bottom outer edge of the lid section 28 and project toward the mid-section 26. Each ear 56 defines an aperture. An identical number of similarly shaped ears 58 are attached to the upper outer edge of the mid-section 26 and project toward the lid section 28. When the lid section 28 is in place, apertures within corresponding ears 56, 58 on the lid section 28 and mid-section 26 are aligned and a pin 54 placed therethrough to lock the lid section 28 in place.

Referring to FIG. 1, the inner structure 16 is positioned between the outer skin 14 and the fin assembly 18. The inner structure 16 has a shape similar to that of the outer skin 14 and includes a dome-shaped top section 60, cylindrical middle section 62, and conical bottom section 64. The dome-shaped top section 60 defines a central aperture 66 that is aligned with the aperture 46 in the outer skin lid section 28 and provides access to the inside of the inner structure 16. The central aperture 66 has a diameter sufficient to provide passage for the beveled flange 50 of the outer skin 14. The conical bottom section 64 of the inner structure 16 defines an outlet 68 at its bottom for the passage of collected paint and solvent. The outlet 68 is aligned with the first circular flange 32 in the outer skin 14.

Referring to FIG. 3, the dome-shaped top section 60 includes a lip 70 of a slightly reduced diameter at its base that fits into the cylindrical middle section 62. The cylindrical middle section 62 defines three slots 72 equally spaced around the top diameter of the middle section 62 that are used to support the fin assembly 18. A group of spacers 74 are attached to the outer surface of the inner structure middle section 62 to space the inner structure 16 from the outer skin 14. The spacers 74 are also attached to the outer skin 14 by welding or screws, thus, the spacers 74 support the inner structure 16. Four upper spacers 74 are placed at equal intervals around the perimeter of the top of the cylindrical middle section 62. Four lower spacers 74 are placed at equal intervals around the perimeter of the bottom of the cylindrical middle section. Naturally, more or less than eight spacers may be used.

Figure 2:
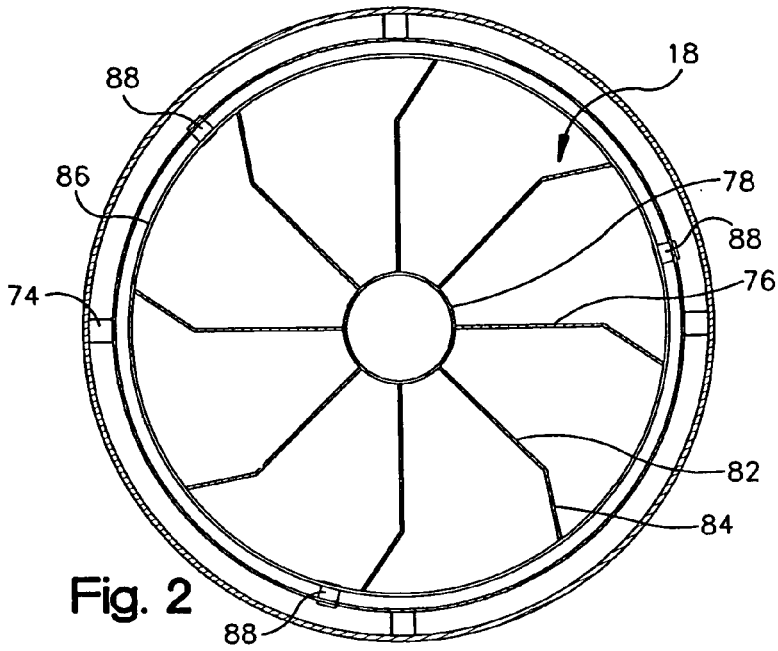
FIG. 2 is a horizontal cross sectional view of the paint gun cleaning apparatus.
Figure 6:
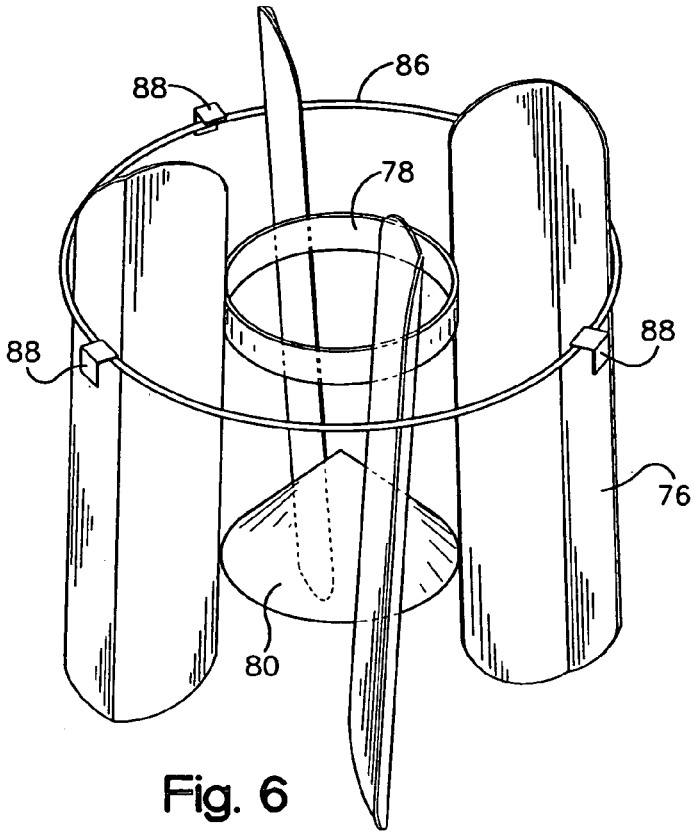
FIG. 6 is a perspective view of the second embodiment of the fin assembly of the paint gun cleaning apparatus.
Figure 7:
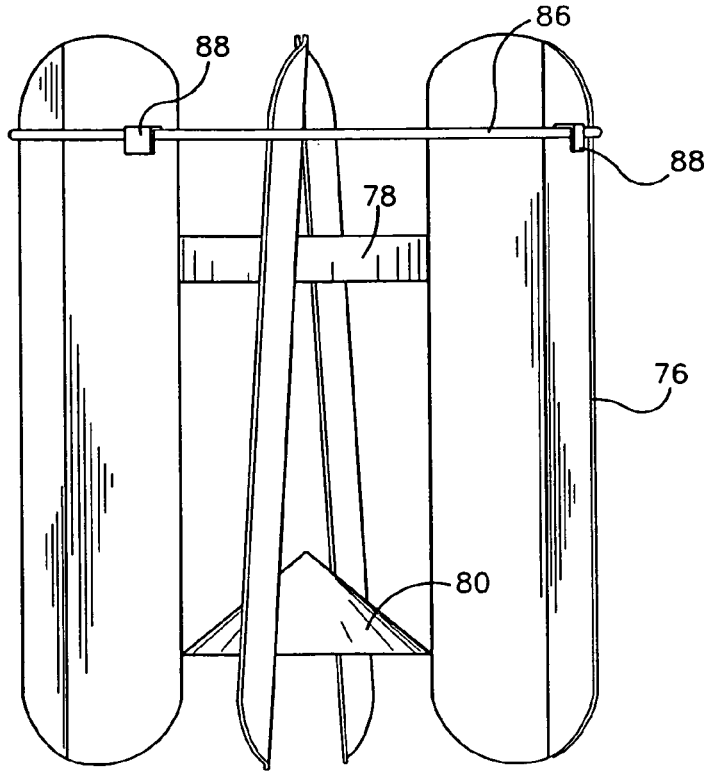
FIG. 7 is a side elevational view of the second embodiment of the fin assembly of the paint gun cleaning apparatus.

Referring to FIGS. 2, 6 and 7, the fin assembly 18 includes a series of fins 76, a central collar 78, and a splash cone 80. The central collar 78 and splash cone 80 are coaxial and aligned with the beveled flange 50 and the first circular flange 32 in the outer skin 14 and define an inner mount to which each of the fins 76 attach. Each fin 76 extends in a spokelike manner from the round central collar 78 toward the middle section 62 of the inner structure 16. Each fin 76 is a generally rectangular member that is oriented generally vertical lengthwise. Each fin may be vertical as represented in FIG. 2 or slightly angled (up to 15 degrees from vertical) as represented in an alternate embodiment of the invention shown in FIGS. 6 and 7. Each fin 76 is bent along a vertical axis giving the fin two separate planer sections 82, 84, although any fin shape may be used (e.g. curved fin). The first planar section 82 of the fin 76 is affixed to the central collar 78 and projects radially outward therefrom. The second planar section 84 is between the first fin section 82 and middle section 62 of the inner structure 16 and is bent clockwise in relation to the first section 82 when viewed from the top of the inner structure 16 (See FIG. 2). Preferably, eight fins 76 protrude from the central collar 78 (See FIG. 2) at equally spaced intervals, although any number of fins 76 may be used (See FIG. 6). The fins 76 block any rotational movement of paint and/or solvent particles discharged from the paint gun 48. The angle of the fins 76 helps to prevent undue turbulence within the drum. The central collar 78 is affixed to the fins 76 at a position approximately one third of the fin length down from the top end of each fin 76.

A splash cone 80 is also attached to the inner edge of each fin 76, the splash cone 80, like the central collar 78, being situated in the center of the inner structure 16. The splash cone 80 is oriented pointing upward and prevents collected paint and solvent from splashing back upward toward the paint gun 48. The splash cone 80 is positioned approximately two thirds of the way down the length of the fins 76.

A hoop 86 made of small diameter rod extends around the outside of the fin assembly 18 at a position near the top of the fin assembly 18. Three small sections of angle stock 88 are welded to the hoop 86 at equally spaced intervals. The angle stock 88 allows the fin assembly 18 to be secured to the inner structure 16. Specifically, the sections of angle stock 88 fit within the slots 72 formed in the inner structure middle section 62 described hereinbefore and allow the fin assembly 18 to be dropped in or pulled out from the top of the drum 12.

Referring to FIG. 1, a source of suction 20 is attached to the nipple 34 attached to the circular flange 32. The source of suction 20 preferably is a Threaded Line Vac manufactured by Exair corporation of Cincinnati, Ohio. A second nipple 35 is affixed to the source of suction 20 opposite the nipple 34. A conical trap 90 is located on a discharge side of the source of suction 20 to remove collected paint and solvent. Collected paint and solvent is continuously or periodically removed from the trap 90 in a manner well known in the art. A second source of suction 22 is attached to the second flange 38 and on request provides additional suction into the drum 12. The second source of suction preferably is a Super Air Amplifier manufactured by Exair corporation of Cincinnati Ohio and described in U.S. Pat. No. 5,402,938 to Sweeney, the entirety of which is incorporated by reference herein. Both the Threaded Line Vac and Super Air Amplifier utilize high pressure compressed air to create a high fluid flow rate from the inside to the outside of the drum.

Referring to FIGS. 1 and 3, the paint gun cleaning apparatus 10 functions to draw paint, solvent, and mixtures thereof away from the discharge end of the paint gun 48 during color changeovers. When a changeover event is initiated, the paint gun 48 is moved robotically to the cleaning apparatus 10. The discharge end of the paint gun 48 is placed within the aperture defined by the outer skin lid section 28. The beveled surface on the paint gun fits against the beveled flange 50 and the seal 52 on the outer skin 14, although a gap is maintained therebetween to avoid over pressurizing the drum. One or both sources of suction 20, 22 are activated to provide a pressure gradient within the drum 12 that draws paint and solvent from the paint gun 48 to the bottom of the drum 12. The suction source(s) 20, 22 are operating as the paint gun 48 enters the aperture.

Once the paint gun 48 is in place, a jet of increased pressure air is blown through the paint gun 48 to help clear the gun of paint of the color being changed. A solvent stream is then forced through the paint gun and into the cleaning apparatus 10. The air jet and solvent steps are each repeated two more times. Then, a stream of paint of a new color is added to the paint gun.

Paint and solvent expelled from the paint gun 48, especially particles moving in a rotational manner, contact the surface of the fins 76 and collect thereon. The angle of the fins helps minimize the amount of paint and solvent that rebounds off the fins and back toward the paint gun 48. Preferably, the fins 76 are angled with the bottom of the fin advanced clockwise with relation to the top of the fin. This orientation helps collect paint and solvent being discharged from the paint gun in a clockwise direction. The paint and solvent then flow downwardly due to suction and gravity. Paint and solvent drips from the bottom of the fins 76 to the conical bottom section 64 of the inner structure 16 and proceeds to the outlet 68 at the lowest point of the bottom section 64. The collected paint and solvent drops from the bottom section 64 of the inner structure 16 to the base 24 of the outer skin 14, then through the first source of suction 20 and into the trap 90. The location of the second vacuum flange 38 on the conical base section 24 of the outer skin 14 prevents migration of the paint and solvent up the slope and into the second flange 38. Thus, no trap is required in conjunction with the second source of suction 22. Preferably the second source of suction provides a high fluid flow rate from the inside to the outside of the drum. The first source of suction provides a lower fluid flow rate as compared to the first source of suction, with the lower flow rate being sufficient to prevent migration of paint and solvent into the second source of suction.

The spray cone 80 prevents any paint or solvent below the spray cone 80 from rebounding upward to the paint gun 48. The spray cone 80 also deflects paint and solvent coming from the discharge end of the paint gun 48 laterally to the fin assembly 18.

The paint gun cleaning apparatus 10 of the present invention provides significant advantages over current devices and practices. Because overspray is drawn away from the discharge end of the paint gun 48 (nozzle and rotating bell), the discharge end stays clean and does not need to be later wiped off by an operator. Safety is improved because an operator does not have to contact the rotating bell or, alternatively, wait for the bell to stop rotating.

Figure 4:
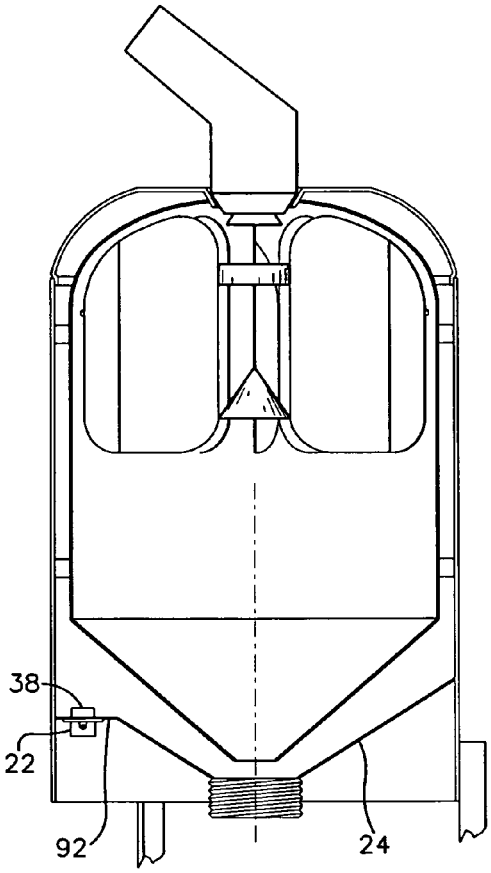
FIG. 4 is a vertical cross sectional view of a second embodiment of the paint gun cleaning apparatus.

In an alternative embodiment of the invention, illustrated in FIG. 4, the generally conical base section 24 includes a horizontal portion 92. The second flange 38 is affixed to the base section at the horizontal portion 92. Also alternatively, know vacuum pumps or blowers may be used in place of the suction sources described above.

Although the invention has been shown and described with reference to certain preferred and alternate embodiments, the invention is not limited to these specific embodiments. Minor variations and insubstantial differences in the various combinations of materials and methods of application may occur to those of ordinary skill in the art while remaining within the scope of the invention as claimed and equivalents.

What is claimed is:

1. A paint gun cleaning apparatus in combination with a paint gun comprising:

a paint gun;

a drum that defines an aperture for insertion of at least a discharge end of said paint gun;

a fin assembly inside said drum for directing material discharged from said paint gun away from said discharge end;

a source of suction that creates a negative pressure within said drum for drawing material discharged from said paint gun within said drum away from the discharge end; and wherein said fin assembly includes a plurality of fins affixed together by a collar.

2. The paint gun cleaning apparatus and paint gun of claim 1, further including a second source of suction, that creates a negative pressure within said drum by removing air therein, for drawing material discharged from said paint gun away from said discharge end.

3. The paint gun cleaning apparatus and paint gun of claim 1, wherein said drum includes an inner structure surrounded by an outer skin, and wherein the inner structure supports said fin assembly.

4. The paint gun cleaning apparatus and paint gun of claim 1, wherein said drum further includes a beveled flange surrounding the aperture defined by the drum.

5. A paint gun cleaning apparatus in combination with a paint gun comprising:

a paint gun;

a drum that defines an aperture for insertion of at least a discharge end of said paint gun;

a fin assembly inside said drum for directing material discharged from said paint gun away from said discharge end;

a source of suction that creates a negative pressure within said drum for drawing material discharged from said paint gun within said drum away from the discharge end; and further including a splash cone as a part of said fin assembly, said splash cone for directing discharge from said paint gun toward fins of said fin assembly.

6. A paint gun cleaning apparatus in combination with a paint gun comprising:

a paint gun;

a drum that defines an aperture for insertion of at least a discharge end of said paint gun;

a fin assembly inside said drum for directing material discharged from said paint gun away from said discharge end;

a source of suction that creates a negative pressure within said drum for drawing material discharged from said paint gun within said drum away from the discharge end, wherein said drum includes an inner structure surrounded by an outer skin, wherein the inner structure supports said fin assembly, and wherein said inner structure includes a removable cover and said outer skin includes a removable lid.

7. The paint gun cleaning apparatus and paint gun of claim 6, wherein said inner structure includes a plurality of slots for engaging said fin assembly.

8. A paint gun cleaning apparatus in combination with a paint gun comprising:

a paint gun;

a drum that defines an aperture for insertion of at least a discharge end of said paint gun;

a fin assembly inside said drum for directing material discharged from said paint gun away from said discharge end;

a source of suction that creates a negative pressure within said drum for drawing material discharged from said paint gun within said drum away from the discharge end; and wherein said fin assembly includes a plurality of fins and each fin is bent along a vertical axis that is parallel to the length of the drum.

9. A paint gun cleaning apparatus comprising:

a drum having an inner structure surrounded by an outer skin that defines an aperture within a top surface of said drum;

a fin assembly configured inside said drum and supported by the inner structure;

a source of suction in fluid communication with said drum, whereby said source of suction creates a pressure gradient from a top to a bottom of said drum; and a splash cone as a part of said fin assembly, said splash cone for directing discharge from said paint gun toward fins of said fin assembly.

10. A method of maintaining a paint gun in a clean state during paint color changeovers comprising the steps of:

providing a paint gun cleaning apparatus, said apparatus including:

a drum that defines said an aperture for insertion of at least a discharge end of a paint gun;

a fin assembly inside said drum for directing material discharged from said paint gun away from said discharge end, wherein said fin assembly extends along the length of the drum and includes a plurality of fins affixed together by a collar;

a source of suction that creates a negative pressure within said drum for drawing material discharged from said paint gun within said drum away from said discharge end;

placing at least said discharge end of said paint gun within said aperture defined by said paint gun cleaning apparatus;

applying a suction force to said paint gun cleaning apparatus to keep paint and solvent overspray from contacting said paint gun.

11. The method of maintaining a paint gun of claim 10, further including a step of applying a second suction force to said paint gun cleaning apparatus.

12. The method of maintaining a paint gun of claim 10, further including a step of directing paint discharged from said paint gun against said fins.

13. The method of maintaining a paint gun of claim 10, further including a step of interrupting circular motion of a paint and solvent mixture discharged from said paint gun discharge end with said fin assembly.

14. A paint gun cleaning apparatus comprising:

a drum that defines an aperture within a top surface of said drum;

a fin assembly configured inside said drum, wherein said fin assembly extends along the length of the drum and includes a plurality of fins affixed together by a collar;

a first source of suction in fluid communication with said drum, whereby said first source of suction creates a negative pressure within said drum that draws air from outside of said drum into said aperture and across said fin assembly from a top to a bottom of said drum, also drawing any paint therein downwards;

and further including a second source of suction in fluid communication with said drum that creates a negative pressure within said drum by removing air from the drum.

15. The paint gun cleaning apparatus of claim 14, wherein each fin is bent along a vertical axis.

16. The paint gun cleaning apparatus of claim 14, wherein said fins are angled fins.

* * * * *